United States Patent [19]

Kobashi et al.

[11] Patent Number: 4,658,004

[45] Date of Patent: Apr. 14, 1987

[54] POLYACRYLONITRILE FIBER WITH HIGH STRENGTH AND HIGH MODULUS OF ELASTICITY

[75] Inventors: Toshiyuki Kobashi; Seiji Takao, both of Okayama, Japan

[73] Assignees: Japan Exlan Company, Ltd.; Toyo Boseki Kabushiki Kaisha, both of Osaka, Japan

[21] Appl. No.: 781,037

[22] Filed: Sep. 27, 1985

[30] Foreign Application Priority Data

Oct. 12, 1984 [JP] Japan ..... 59-214872

[51] Int. Cl.[4] ..... C08F 20/44

[52] U.S. Cl. ..... 526/341

[58] Field of Search ..... 526/341, 342

[56] References Cited

U.S. PATENT DOCUMENTS 3,975,337 8/1976 Reinehr ..... 526/341
4,108,845 8/1978 Reinehr ..... 526/341
4,140,844 2/1979 Lohwasser ..... 526/341
4,421,708 12/1983 Reichardt ..... 526/341
4,540,754 9/1985 Kobashi ..... 526/341

*Primary Examiner*—Paul R. Michl
*Attorney, Agent, or Firm*—Wenderoth, Lind & Ponack

[57] ABSTRACT

The invention provides a polyacrylonitrile fiber having a tensile strength above 13 g/d and a modulus of elasticity above $2.4\times10^{11}$ dyne/cm$^2$, which is useful for tire cords, fiber-reinforced composite materials, precursors for producing carbon fiber, etc. The fiber is produced by integrally combining technical means which comprise using a polymer composed mainly of acrylonitrile whose weight average molecular weight is more than 400,000 and $\overline{M}w/\overline{M}n$ ratio is less than 7.0; preparing a spinning solution from the polymer; spinning the solution into filaments; subjecting the resulting filaments to multistage stretching; and drying the filaments, all these steps being conducted under particular conditions.

7 Claims, No Drawings

POLYACRYLONITRILE FIBER WITH HIGH STRENGTH AND HIGH MODULUS OF ELASTICITY

BACKGROUND OF THE INVENTION (a) Field of the Invention

The present invention relates to a polyacrylonitrile (PAN) fiber having high strength and high modulus of elasticity and more particularly to a PAN fiber composed of an acrylonitrile (AN) polymer with high molecular weight and sharp molecular weight distribution, and having an excellent strength and an excellent modulus of elasticity.

(b) Description of the Prior Art

PAN fiber, one of the "three big fibers" and ranking with nylon and polyester fibers, is widely used in the field of wearing apparel which makes the most of its characteristics such as clearness of dyed color, bulkiness, etc. The strength of the PAN fiber for use in such wearing apparel is in the order of 3 to 4 g/d.

Carbon fiber produced by carbonizing PAN fiber is marked in recent years as reinforcing fiber for composite materials because of its excellent physical properties (high strength, high modulus of elasticity). Since the surface condition, cross-sectional shape, physical properties, etc. of the carbon fiber are determined for the most part by the characteristics of the starting material PAN fiber (precursor), its improvements are contemplated actively. However, the strength of the precursor produced on an industrial scale is generally limited to about 5 to 8 g/d.

On the other hand, the aromatic polyamide fibers represented by Kevlar ® produced by Du Pont, have a strength higher than 20 g/d owing to their rigid molecular structure, and therefore they are establishing a firm position as reinforcing fiber for tire cords and composite materials.

Accordingly, it is hoped that a PAN fiber of high strength and high modulus of elasticity will come into production which can be used as a precursor for producing carbon fiber of excellent physical properties for spatial and aeronautic use for which high reliability is required, or as a reinforcing fiber by itself.

SUMMARY OF THE INVENTION

Under such circumstances, we conducted research for producing a novel PAN fiber of high strength and high modulus of elasticity which by far exceeds the conventional level of technique. As a result, it has been found possible to produce a PAN fiber having a tensile strength above 13 g/d and a modulus of elasticity above $2.4\times10^{11}$ dyne/cm$^2$ by integrally combining technical means which comprise using an AN polymer having a special molecular weight and a sharp molecular weight distribution; preparing a spinning solution from the polymer; spinning the solution into filaments; coagulating the resulting filaments; subjecting the coagulated filaments to multistage stretching; and then drying the filaments, all these steps being conducted under particular conditions. The present invention has been achieved on the basis of this discovery.

Therefore, an object of the present invention is to provide a PAN fiber of high strength and high modulus of elasticity which by far exceeds the conventional level of technique.

Another object of the invention is to provide a PAN fiber of high strength and high modulus of elasticity which can exhibit a remarkable effect in the field of industrial use such as a reinforcing fiber for tire cords, resins, etc. and precursor for producing carbon fiber.

Other objects of the invention will become apparent from the following detailed explanation.

The PAN fiber which makes it possible to attain such objects of the present invention is a fiber having a tensile strength above 13 g/d and a modulus of elasticity above $2.4\times10^{11}$ dyne/cm$^2$, produced from a polymer composed mainly of AN and whose weight average molecular weight is above 400,000 and $\overline{M}w/\overline{M}n$ ratio is less than 7.0.

DETAILED DESCRIPTION OF THE INVENTION

In the following, the invention will be explained in detail.

First, in the production of the PAN fiber of high strength and high modulus of elasticity, to which the present invention is directed, the characteristics of the polymer composing the fiber is important. It is necessary to use a polymer having a weight average molecular weight from 400,000 to 2,500,000, preferably from 800,000 to 2,250,000, and a $\overline{M}w/\overline{M}n$ ratio less than 7.0, preferably less than 5.0.

As described in Jornal of Polymer Science (A-1) vol. 6, pp 147–159 (1968), the weight average molecular weight ($\overline{M}w$) is obtained by measuring the intrinisc viscosity [$\eta$] of the polymer in dimethylformamide (DMF) and calculating from the following formula:

$$[\eta]=3.35\times10^{-4}\overline{M}_w^{0.72}$$

The $\overline{M}w/\overline{M}n$ ratio was calculated from the abovementioned $\overline{M}w$ and the number average weight ($\overline{M}n$) measured by the osmotic pressure method described in Journal of Polymer Science (A-1), vol. 5, pp 2857–2865 (1967).

To produce such a polymer, any method can be used without limitation as long as a polymer having a weight average molecular weight above 400,000 and whose $\overline{M}w/\overline{M}n$ ratio is less than 7.0, is obtained. However, the polymer can be produced advantageously on an industrial scale by suspension-polymerizing the monomer in an aqueous medium containing a water-soluble polymer, in the presence of an oil-soluble initiator, while maintaining an unreacted monomer concentration higher than 9 weight %, based on the total amount of the monomer and water charged in the polymerization system. It is desirable to use as the monomer, AN alone or a monomer mixture composed of more than 85 weight % AN, preferably more than 95 weight % AN, and a known comonomer copolymerizable with AN.

The production of the fiber having high strength and high modulus of elasticity necessitates the use of the abovementioned polymer of high molecular weight and small $\overline{M}w/\overline{M}n$ ratio (that is to say, a polymer of uniform, long molecular chains with a minor amount of low molecular weight molecules which hinder the crystallization, orientation, uniform coagulation, etc. of the polymer). The production of such a fiber also depends on to what extent the molecular chains forming the fiber are extended in the fiber axis direction to their full length. For the attainment of such a state, it is important to produce a polymer solution (spinning solution) in which the polymer chains are sufficiently disentangled so that the molecular chains can be easily arranged in parallel and oriented in the fiber axis direction in the steps of spinning and stretching. As examples of the solvents for producing such a polymer solution, there may be mentioned organic solvents such as DMF, dimethylacetamide, dimethyl sulfoxide, etc. and inorganic solvents such as thiocyanates, zinc chloride, nitric acid, etc. In the wet spinning process, inorganic solvents are superior because they give coagulated filaments of better uniformity. Among them, thiocyanates are preferred. It is necessary that the polymer concentration should be set low, because the viscosity of the spinning solution tends to be high owing to the high molecular weight of the polymer. In addition, the concentration depends on the kind of the solvent, molecular weight of the polymer, etc. Therefore, it is difficult to set it definitely. However, it is desirable to set it generally within the range of from 4 to 20 weight %, preferably within the range of from 5 to 15 weight %. The dissolution temperature of the polymer is desirably 70° to 130° C., and the viscosity of the polymer at 30° C. is desirably within the range of from 500,000 to 10,000,000 c.p.s. Since the viscosity of the high molecular weight polymer solution is high, its defoamation becomes extremely difficult once it contains air bubbles. Also, the air bubbles contained in the spinning solution not only hinder the parallel arrangement and orientation of the molecular chains, but also they themselves form a great defect and a cause of an extreme drop of the strength of the fiber finally obtained. Therefore, it is necessary to dissolve the polymer while defoaming the solution under reduced pressure.

As for the spinning method, any of dry spinning, wet spinning and dry/wet spinning may be employed. However, because the viscosity is higher than that of the usual spinning solution, dry/wet spinning in which the spinning solution is once extruded into air through a spinnerette and thereafter immersed in a coagulation solution, is preferable in respect of spinnability.

In order that the fiber can withstand the severe stretching in the suceeding steps, it is desirable to produce uniform, coagulated gel filaments. Therefore, it is important to establish a coagulation condition under which slow coagulation takes place. An especially recommended method is the use of an inorganic solvent together with coagulation at a low temperature below room temperature. When an organic solvent is used, it is preferable to use multistage coagulation in which the filaments are made to pass successively through coagulation baths containing a non-solvent (precipitating agent) with gradually increased concentrations. The diameter of the coagulated filaments also has an influence on the uniformity of the gel filaments. The finer the better as far as filament breakage does not take place, and in general it is desirable to control the diameter to within the range of from 50 to 300μ.

In the following, an explanation will be given on stretching which is an important step in revealing the latent fiber properties of high strength and high modulus of elasticity which have been given to the fiber in the previous steps such as polymer solution preparation, spinning, coagulation, etc.

For such a stretching means, it is necessary to conduct multistage stretching under a temperature condition established so that the later the stretching stage the higher the temperature. An example of a preferred embodiment of such multistage stretching is to carry out stretching operations in succession which comprise stretching gel filaments containing residual solvent (the so-called plastic stretching); stretching in hot water; once drying as required; and stretching in steam or in a high boiling point medium having a boiling point higher than 100° C. Multistage stretching in the same kind of medium at different temperatures is effective in the improvement of stretchability.

Since stretching in steam generally tends to form voids in the filaments, it is preferable to carry out stretching in a high boiling point medium having a boiling point higher than 100° C., at a temperature from 100° to 180° C., preferably from 120° to 170° C., and multistage stretching under such conditions is especially preferable. As such high boiling point media, water-soluble polyhydric alcohols are preferable, and examples of such alcohols are ethylene glycol, diethylene glycol, triethylene glycol, glycerin, 3-methylpentane-1,3,5-triol, etc. Among them, ethylene glycol and glycerin are especially recommended. When the stretching temperature exceeds the upper limit of the above-mentioned preferable range, the filaments will be broken by fusion, so that such a temperature must be avoided.

Dry heat stretching in the temperature range of from 150° to 230° C. may be employed, but is not advantageous in respect of stretchability.

When the stretching operation in a high boiling point medium is employed, the filaments are dried after water-washing, and when said stretching operation is not employed the filaments are dried without treatment. If polyhydric alcohol remains in the finally obtained filaments, it acts as a plasticizer and lowers the strength. Therefore, the filaments must be washed to an alcohol content of less than 5 weight %.

The drying operation must be conducted under tension (limited shrinkage, preferably constant length), because when heat relaxation occurs the strength will be lowered. Even under tension, too high a temperature causes a decrease in strength, so that it is necessary to carry out drying at a temperature lower than 130° C., preferably from 80° to 120° C.

We have not yet clarified why the present invention can provide a novel PAN fiber of high strength and high modulus of elasticity which by far exceeds conventional level of technique. However we believe that the reason is as follows:

By using as the starting material, a polymer of high molecular weight and small $\overline{M}w/\overline{M}n$ ratio (in other words, a polymer of uniform, long molecular chains with minor amount of low molecular weight molecules which hinder the crystallization, orientation, uniform coagulation, etc. of the polymer), and by employing the technical means recommended in the present invention, in each step of preparation of the polymer solution, spinning, coagulation, stretching, drying, etc., the filaments are removed from any defects resulting from air bubbles, etc. and the uniform, long molecular chains of the polymer are arranged in parallel in the fiber axis direction so as to form chains extended to their full length. Thus a highly crystallized and oriented PAN fiber with strength and modulus of elasticity greatly improved over the conventional level of technique can be obtained.

The PAN fiber thus obtained has a tensile strength above 13 g/d, desirably above 15 g/d, more desirably above 17 g/d, and a modulus of elasticity above $2.4\times10^{11}$ dyne/cm$^2$, preferably above $2.8\times10^{11}$ dyne/cm$^2$.

Such a PAN fiber of high strength and high modulus of elasticity can be widely used as a reinforcing fiber for tire cords and fiber-reinforced composite materials, and as precursors for producing carbon fiber.

For a better understanding of the present invention, an example is shown in the following. However, the present invention is not limited for its scope by the description of the example. In the example, percentages are by weight unless otherwise indicated.

EXAMPLE

Aqueous suspension polymerization of AN was conducted, using 2,2'-azobis-(2,4-dimethylvaleronitrile) as the oil-soluble initiator. As the dispersion stabilizer, a partially saponified (degree of saponification: 87%) polyvinyl alcohol having a degree of polymerization of 2000, was used. By varying the ratio of charged monomer/water and the quantity of the initiator, five kinds of polymers (a–e) having various molecular weights shown in Table 1, were produced.

Each of the polymers thus obtained was washed with warm water at 50° C., and after drying and pulverization, it was dissolved in aqueous 50% solution of sodium thiocyanate, while at the same time the solution was defoamed under reduced pressure. Thus five kinds of spinning solutions were produced.

After filtration, each of the spinning solutions was spun under the dry/wet system through a spinnerette having 0.15 mmϕ orifices, with the distance between the coagulation bath surface and the spinnerette surface being maintained at 5 mm. The temperature of the spinning solution at the time of extrusion was kept at 80° C. and the coagulation bath was regulated to a sodium thiocyanate concentration of 15% and a temperature of 5° C.

The gel filaments which came out of the coagulation bath were stretched twice in length, while they were washed with deionized water. The filaments which left the washing step were then stretched twice in length in hot water of 85° C., 2.5 times in boiling water, and subjected to 2-stage stretching in ethylene glycol (EG). The first EG bath was maintained at 130° C. and the second bath at 160° C. The stretching ratio in each bath was varied as shown in Table 1.

The filaments which came out of the second EG bath were washed with warm water of 60° C. until the residual content in the filaments reached an amount less than 0.5 weight %, and were dried at 100° C. under tension. Thus, five kinds of fibers (A–E) were produced. Fiber (F) was produced in the same way as Fiber (B) except that the drying temperature was 140° C.

The thus-obtained six kinds of fibers were measured for the tensile strength and modulus of elasticity. The results are shown in Table 1. The tensile strength is a value measured by the constant speed elongation tester (UTM-II type Tensilon) of the tensile testing method of fibers according to JIS L 1069, with a grip gap of 20 mm and an elongation speed of 100%/min. The modulus of elasticity is a dynamic modulus of elasticity (E') measured by the tester of elasticity (Vibron, DDV 5 type produced by Toyo Measuring Apparatus Co.) with a test sample length of 4 cm and a driving frequency of 110 c.p.s.

TABLE 1

| | | Specimen of the invention | | Specimen for comparison | | | |
|---|---|---|---|---|---|---|---|
| | Fiber name | A | B | C | D | E | F |
| | Polymer name | a | b | c | d | e | b |
| Spinning solution | Ratio charged monomer/water | 1/3 | 1/3 | 1/6 | 1/3 | 1/6 | 1/3 |
| | Initiator (%/monomer) | 0.22 | 0.61 | 1.04 | 2.80 | 0.72 | 0.61 |
| | Molecular weight of polymer | 1350,000 | 530,000 | 320,000 | 120,000 | 450,000 | 530,000 |
| | $\overline{M}w/\overline{M}n$ ratio | 4.5 | 3.9 | 6.2 | 4.5 | 7.1 | 3.9 |
| | Polymer concentration (%) | 5 | 11 | 15 | 24 | 13 | 11 |
| Stretching ratio in EG | First bath | 1.8 | 1.8 | 2 | 2 | 2 | 1.8 |
| | Second bath | 1.6 | 2 | 3 | 4 | 2 | 2 |
| Total stretching ratio | | 28.8 | 36 | 60 | 80 | 42 | 36 |
| Tensile strength (g/d) | | 18.8 | 17.2 | 14.3 | 8.6 | 13.8 | 12.5 |
| Modulus of elasticity ($\times 10^{11}$ dyne/cm$^2$) | | 3.2 | 2.6 | 1.8 | 1.1 | 2.0 | 2.0 |

From the above Table, it is understood that, when an AN polymer having a molecular weight less than 400,000 and having a $\overline{M}w/\overline{M}n$ ratio exceeding 7.0, a PAN fiber having a sufficient strength and modulus of elasticity cannot be obtained even by employing the spinning and after-treatment methods recommended in the present invention, and in the case of the fiber whose drying temperature is out of the upper limit of the range of the invention (Fiber F), a fiber of high strength and high modulus of elasticity cannot be obtained, whereas the fibers of the present invention have excellent strength and modulus of elasticity.

What we claim is:

1. A polyacrylonitrile fiber of high strength and high modulus of elasticity having a tensile strength above 13 g/d and a modulus of elasticity above $2.4\times10^{11}$ dyne/cm$^2$, and said fiber being produced under the following conditions:

(i) preparing a spinning solution of a polymer mainly composed of acrylonitrile, said polymer having a $\overline{M}w\geqq400,000$ and $\overline{M}w/\overline{M}n\leqq7.0$, in which solution, the polymer molecular chains are sufficiently loosened or extended in the fiber axis direction, and wherein the polymer is dissolved under reduced pressure for defoaming so that the solution will not contain air bubbles;

(ii) spinning the polymer solution to form gel filaments, (iii) coagulating said gel filaments under slow coagulation conditions to produce uniform coagulated gel filaments;

(iv) subjecting the filaments to a multistage heat stretching process in which the later the stretching stage the higher the temperature and (v) drying the filaments under tension at a temperature below 130° C. to avoid a strength drop associatd with heat relaxation.

2. The fiber as claimed in claim 1, wherein the weight average molecular weight of the polymer composed mainly of acrylonitrile is more than 800,000.

3. The fiber as claimed in claim 1, wherein the $\overline{M}w/\overline{M}n$ ratio of the polymer composed mainly of acrylonitrile is less than 5.0.

4. The fiber as claimed in claim 1 composed of a polymer of acrylonitrile alone or a polymer containing more than 85 weight % of acrylontrile.

5. The fiber as claimed in claim 1 having a tensile strength more than 15 g/d.

6. The fiber as claimed in claim 1 having a tensile strength more than 17 g/d.

7. The fiber as claimed in claim 1 having a modulus of elasticity more than $2.8\times10^{11}$ dyne/cm$^2$.

* * * * *